US008572770B2

(12) United States Patent
Barba et al.

(10) Patent No.: US 8,572,770 B2
(45) Date of Patent: Nov. 5, 2013

(54) COLLAPSIBLE BATHTUB

(75) Inventors: Kim Barba, Viborg (DK); Niels Peter Estrup, Hinnerup (DK)

(73) Assignee: Stokke AS, Alesund (NO)

( * ) Notice: Subject to any disclaimer, the term of this patent is extended or adjusted under 35 U.S.C. 154(b) by 617 days.

(21) Appl. No.: 12/513,724

(22) PCT Filed: Nov. 7, 2007

(86) PCT No.: PCT/DK2007/000484

§ 371 (c)(1),
(2), (4) Date: Jun. 23, 2009

(87) PCT Pub. No.: WO2008/055500

PCT Pub. Date: May 15, 2008

(65) Prior Publication Data

US 2011/0083262 A1 Apr. 14, 2011

(51) Int. Cl.
*A47K 3/02* (2006.01)

(52) U.S. Cl.
USPC ..... 4/584

(58) Field of Classification Search
USPC ..... 4/538–595
See application file for complete search history.

(56) References Cited

U.S. PATENT DOCUMENTS

| | | | | | |
|---|---|---|---|---|---|
| 2,239,969 | A | * | 4/1941 | Morthland | 428/74 |
| 2,505,845 | A | * | 5/1950 | Alvarez | 4/588 |
| 2,950,484 | A | * | 8/1960 | Jaffe | 4/587 |
| 3,401,409 | A | * | 9/1968 | Ekrut | 4/484 |
| 3,925,828 | A | * | 12/1975 | Kim | 4/599 |
| 4,017,915 | A | * | 4/1977 | Prewitt | 4/585 |
| 4,117,558 | A | * | 10/1978 | Poth | 4/575.1 |
| 4,785,486 | A | * | 11/1988 | Viesturs | 4/585 |
| 4,862,527 | A | * | 9/1989 | McAllister | 4/612 |
| 4,989,279 | A | * | 2/1991 | Powell | 4/612 |
| 5,315,721 | A | * | 5/1994 | Okun | 4/599 |
| 5,317,765 | A | * | 6/1994 | Knoedler et al. | 4/572.1 |
| 5,379,466 | A | * | 1/1995 | Davies | 4/449 |
| 5,649,330 | A | * | 7/1997 | Lind | 4/545 |
| 5,661,856 | A | * | 9/1997 | Kyte | 4/584 |
| 5,666,677 | A | * | 9/1997 | Crawford et al. | 4/540 |

(Continued)

FOREIGN PATENT DOCUMENTS

| | | |
|---|---|---|
| CN | 2055704 | 4/1990 |
| FR | 2772348 A1 | 12/1997 |
| GB | 1321733 | 6/1973 |
| GB | 2203131 A | 10/1988 |

OTHER PUBLICATIONS

International Preliminary Report on Patentability; International Application No. PCT/DK2007/000484; Completed Feb. 11, 2009.

(Continued)

*Primary Examiner* — Lori Baker
(74) *Attorney, Agent, or Firm* — Mollborn Patents, Inc.; Fredrik Mollborn

(57) ABSTRACT

A collapsible bathtub comprising bottom and side walls made of plastic, wherein the bathtub comprises at least one flexible bendable joint around which flexible bendable joint at least a part of said bottom and/or side walls are folded such that said bathtub has a collapsed position, wherein at least a part of said bendable joint is made of a flexible plastic material being more flexible than the remaining part of said bathtub and wherein the sidewalls of said bathtub are directly connected and when collapsing said bathtub, said bottom is pressed upwards between said side walls.

13 Claims, 6 Drawing Sheets

(56) References Cited

U.S. PATENT DOCUMENTS

| | | | | |
|---|---|---|---|---|
| 5,790,992 | A * | 8/1998 | Ray | 4/599 |
| 5,809,588 | A * | 9/1998 | Angelotti | 4/587 |
| 6,047,414 | A * | 4/2000 | Bailey | 4/484 |
| 6,463,599 | B1 * | 10/2002 | Perthu | 4/599 |
| 6,510,565 | B1 * | 1/2003 | Zwezdaryk | 4/531 |
| 6,615,762 | B1 * | 9/2003 | Scott | 114/353 |
| 6,647,562 | B1 * | 11/2003 | Arout et al. | 4/506 |
| 6,802,088 | B1 * | 10/2004 | Gruner | 4/555 |
| 7,047,577 | B1 * | 5/2006 | Cirilli | 4/599 |
| 7,540,041 | B2 * | 6/2009 | Gara et al. | 4/483 |
| 2007/0074674 | A1 * | 4/2007 | Miller | 119/671 |
| 2007/0205243 | A1 * | 9/2007 | Potts et al. | 224/539 |
| 2009/0158521 | A1 * | 6/2009 | Richardson et al. | 4/572.1 |
| 2011/0083262 | A1 * | 4/2011 | Barba et al. | 4/585 |

OTHER PUBLICATIONS

PCT International Search Report; PCT/DK2007/000484; Mailed Feb. 20, 2008.

* cited by examiner

COLLAPSIBLE BATHTUB

CROSS-REFERENCE TO RELATED APPLICATIONS

This application is a national phase application of PCT Application No. PCT/DK2007/000484, filed on Nov. 7, 2007, titled "A Collapsible Bathtub," which in turn claims priority to Danish Application No. PA200601445, filed on Nov. 7, 2006. The subject matter of both of these applications are incorporated herein by reference.

BACKGROUND

A bathtub typically takes up a lot of space in the bathroom; either it is moulded into the bathroom or it is freestanding. A bathtub is usually something that is selected when building the bathroom, and ultimately it is the individual user of the bathroom who decides whether there is a need for a bathtub.

In connection with an increase in family, a bathtub is however a necessity for most people, and if you are not already in possession of a bathroom with a bathtub, it is necessary to invest in a freestanding bathtub for the children. This may also be necessary even if there is a bathtub as this is typically too big for the younger children. Such a tub typically takes up quite some space in the bathroom, and it may be difficult to find space for it when the tub is not in use. In addition, it is difficult to handle the tubs, both because of their weight and because of their size which is the case both when the tub is being used and when it is to be stored subsequently. Finally, the entire process of filling up and emptying the separate tub is typically also a quite cumbersome and demanding process. A further problem arises when a family travels to places where there is necessarily no bathtub for younger children, and they must therefore bring their own bathtub. It is very inconvenient to bring a bathtub on a holiday due to the fact that it is big, heavy and unwieldy, and the consequence is often that one does not bring a bathtub, but simply hopes that there is a one at the destination.

U.S. Pat. No. 2,950,484 describes a foldable bathtub comprising a generally rectangular body of a water-proof material such as a flexible plastic material or the like, the body including a pair of relatively foldable side portions which are connected at a transverse bisecting plane by relatively yieldable fold line portions. The relatively yieldable fold line portions are embodied as very thin oblong profiles and are thus very sensitive to wear when the bathtub is folded and unfolded, and the bathtub is therefore often leaking at the yieldable fold line. Further, the bathtub disclosed in U.S. Pat. No. 2,950,484 needs strengtheners mounted at the side portions of the bathtub in order to be stable.

SUMMARY

Various embodiments of the invention provide a collapsible bathtub which solves the above-mentioned problems.

In one aspect, this is achieved by a collapsible bathtub comprising bottom and side walls made of plastic, wherein the bathtub comprises at least one flexible bendable joint around which flexible bendable joint at least a part of said bottom and/or side walls are folded such that said bathtub has a collapsed position wherein at least a part of said bendable joint is made of a flexible plastic material being more flexible than the remaining part of said bathtub and wherein the sidewalls of said bathtub are directly connected and when collapsing said bathtub, said bottom is pressed upwards between said side walls. It is hereby advantageously achieved that the bendable joint is constructed as a tight bendable joint since the flexible plastic material is waterproof and at the same time allows bending of the more flexible plastic material. The bendable joint is constructed of a more flexible plastic material than the remaining part of the bathtub, thus improving the stability of the bathtub's side walls and bottom, and the bendable joint can therefore be designed to have the same dimensions as the remaining part of the bathtub and thus be more resistant to wear. The aesthetic look of the bathtub is also improved as the bathtub looks like a regular bathtub. It is further achieved that the volume and/or surface area of the collapsible bathtub is reduced when having a collapsed position and the collapsible bathtub may be collapsed and unfolded many times without tearing. This entails that the bathtub takes up less space and thus is easier to store and transport. It is hereby advantageously achieved that the bathtub with flexible bendable joints could be constructed of plastic such as polypropylene copolymers and thermoplastic elastomers, where the bendable joints are made of thermoplastic elastomers, and where the bottom and side walls are made of polypropylene copolymers. The bottom, side walls and bendable joints could then be integrated with each other, thereby ensuring that the bathtub remains tight. In addition a simple, easy and quick production of the bathtub is ensured in that standardized moulding processes may be used.

The invention in accordance with one aspect is defined by the independent claim, and other embodiments of the invention are defined by the dependent claims. The benefits and advantages of the present invention are explained and discussed in the detailed description.

DESCRIPTION OF THE DRAWINGS

In the following the invention is described with reference to the figures, where.

DETAILED DESCRIPTION

Figure 1:
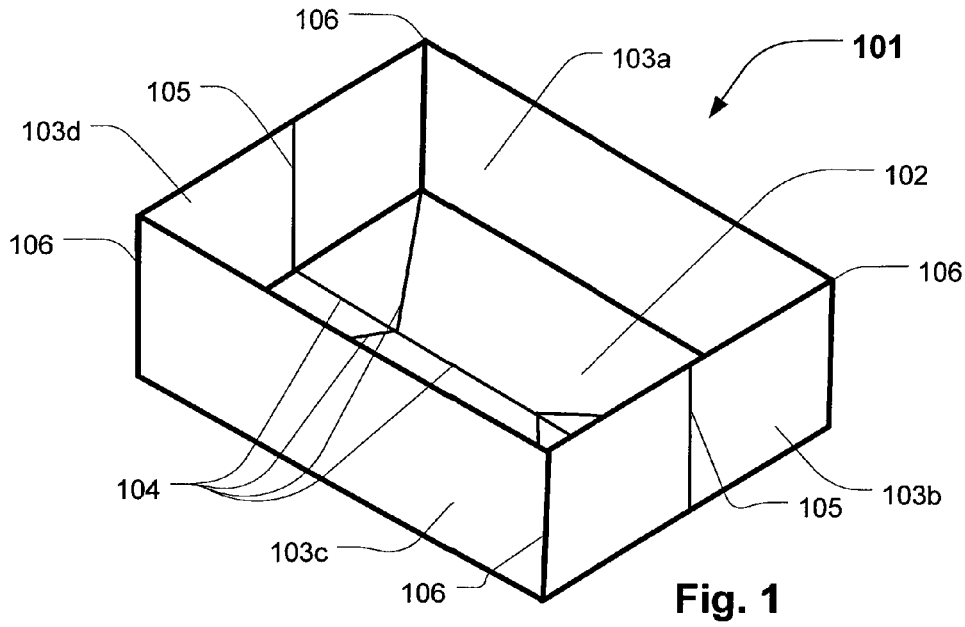
FIG. 1 illustrates a collapsible bathtub in accordance with one embodiment of the invention in an unfolded position.

FIG. 1 shows a collapsible bathtub (101) according to one embodiment of the invention in an unfolded position. The bathtub comprises a bottom (102) and four side walls (103*a*, 103*b*, 103*c*, 103*d*). The bathtub further comprises flexible bottom bendable joints (104) around which a part of the bottom is folded and flexible side bendable joints (105) around which some of the side walls are folded, and in addition the edges of the bathtub are constructed as flexible edge bendable joints (106) around which two different side walls may be folded.

Figure 2:
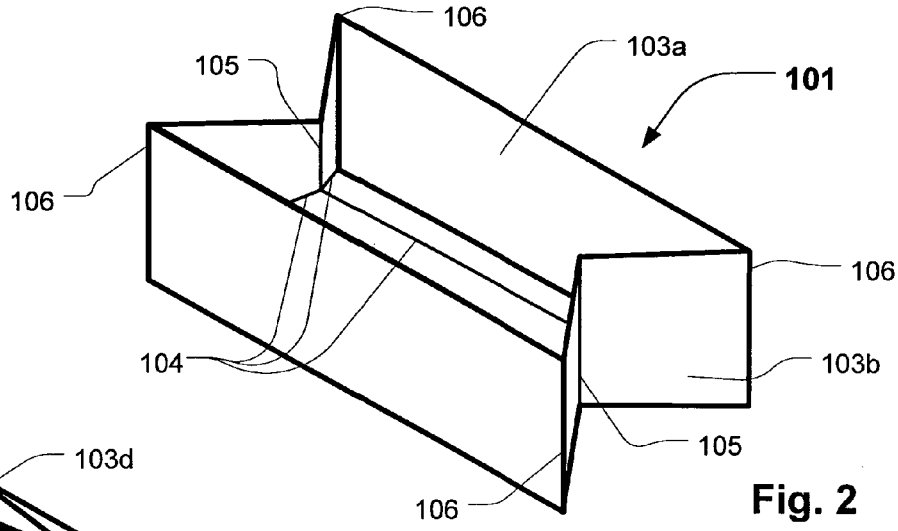
FIG. 2 illustrates the bathtub in a semi-collapsed position in accordance with one embodiment of the invention.

FIG. 2 shows the collapsible bathtub in a semi-collapsed position and illustrates that the bottom (102) is folded around the flexible bottom bendable joints (104) such that a part of the bottom is lifted between the side walls (103*a* and 103*c*) simultaneously with the side walls (103*b*) and (103*d*) being folded around the flexible side wall bendable joints (105), and simultaneously with the flexible edge bendable joints being folded (106) such that the side walls (103*b*) and (103*d*) are folded in between the side walls (103*a*) and (103*c*).

Figure 3:
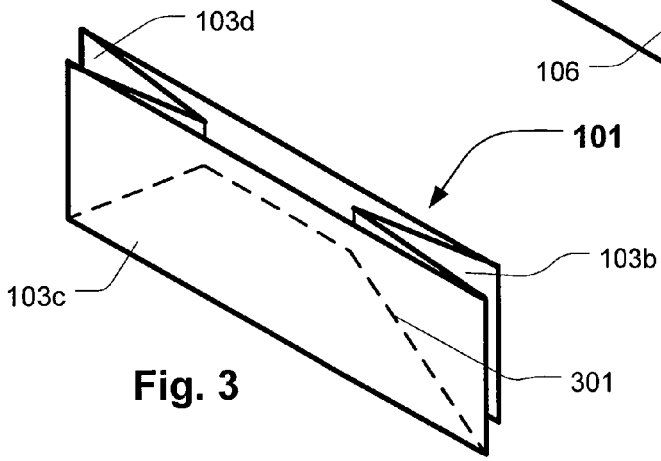
FIG. 3 illustrates a bathtub in a collapsed position in accordance with one embodiment of the invention.

FIG. 3 shows the bathtub in a collapsed position and illustrates how the side walls (103*a*) and (103*c*) and the bottom (102) are positioned in between the side walls (103*b*) and (103*d*) when the bathtub is in a collapsed position. The position of the bottom between the side walls (103*a*) and (103*c*) are illustrated by way of dotted lines (301). The result is that the bathtub takes up a lot less space when being collapsed than when being unfolded.

Figure 4:
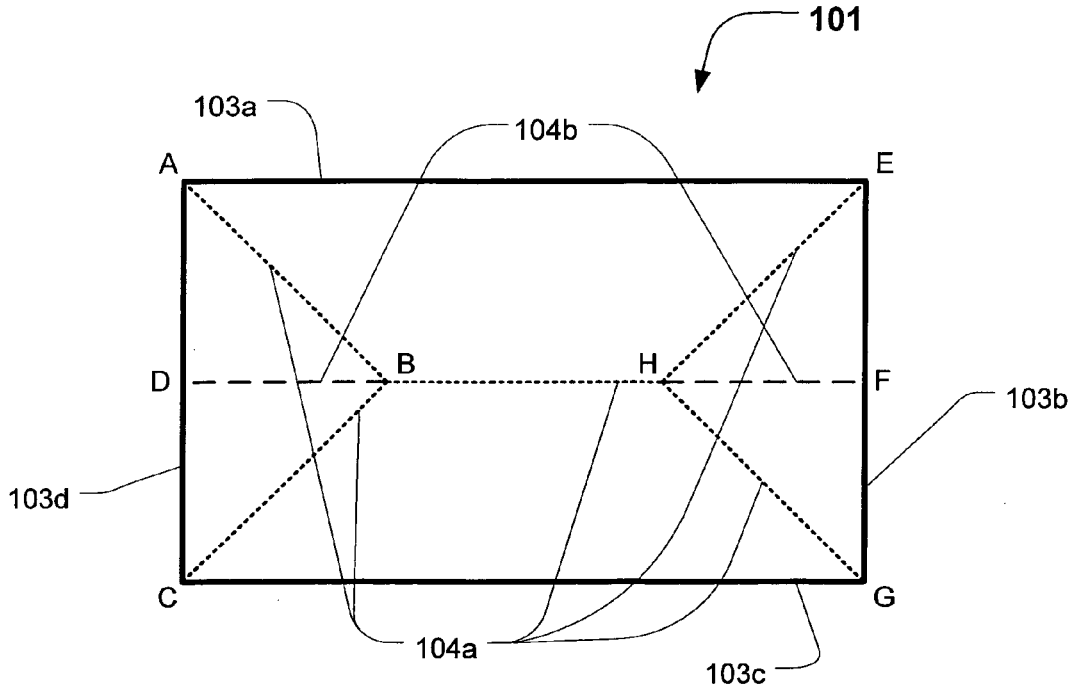
FIG. 4 illustrates the bathtub in an unfolded position and seen from above in accordance with one embodiment of the invention.

FIG. 4 illustrates the bathtub in an unfolded position and seen from above. The position of the flexible bottom bendable joints (104) is shown such that bottom bendable joints adapted for bending the bottom parts upwards (out of the page) are illustrated by dotted lines (104*a*), and bottom bendable joints adapted for bending the bottom parts downwards (into the page) are illustrated by dashed lines (104*b*). This position of the bottom bendable joints results in the fact that the triangles ABC and EGH may be folded up around bottom bendable joint BD and HF, respectively, when the bottom bendable joints AB, BC, BH, HE and HG are folded up. The result is that the bottom parts may be lifted to upright position such that trapezes ABHE and CBHG are positioned substantially parallel relative to one another in an upright position, while the triangles ABC and EGH are folded up and in between the outer part of the two trapezes. The length of the bottom bendable joints DB and HF is in this embodiment adapted to equal half the width of the bathtub as this makes the side walls (103*b*), (103*d*) and the bottom foldable in between the side walls (103*a*) and (103*c*). If the length of the bendable joints DB and HF is longer than half the width of the bathtub, a part of the bottom will project from the side walls (103*a*) and (103*c*), while a part of the side walls (103*b*) and (103*d*) will project from the sides (103*a*) and (103*c*) if the bendable joints DB and HF are shorter than half the width of the bathtub.

Figure 5:
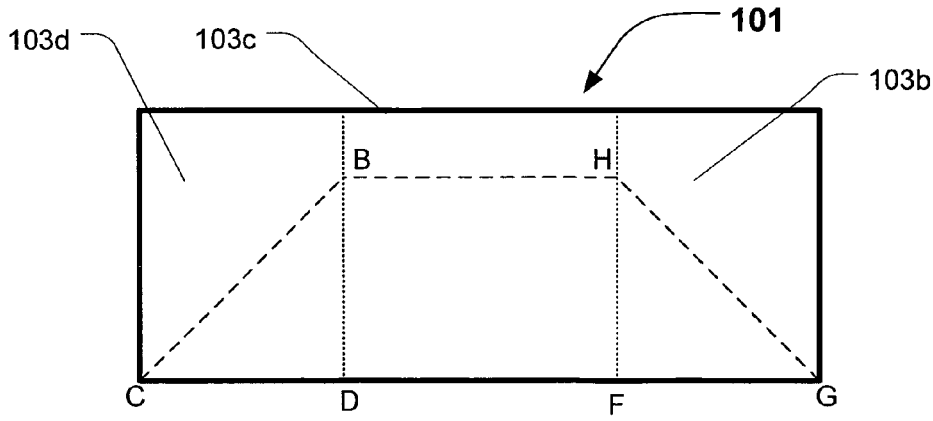
FIG. 5 illustrates a front view of the bathtub in a collapsible position in accordance with one embodiment of the invention.

FIG. 5 shows the bathtub in a collapsed position and seen from the front. The inner structures of the bottom are illustrated by way of dotted lines. The dotted lines illustrate that the side walls (103*c*) and (103*b*) are folded in between the two trapezes.

Figure 6A:
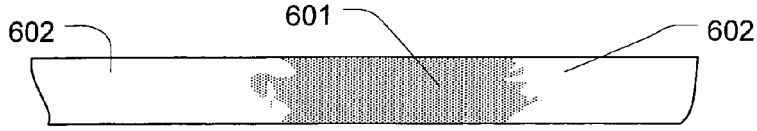
FIGS. 6-9 illustrate different embodiments of bendable joints.
Figure 6B:
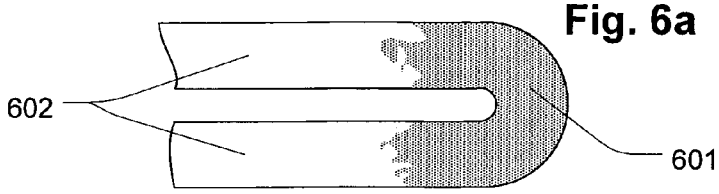

FIG. 6 illustrates an embodiment of a bendable joint and shows a cross-sectional view of the bendable joint in an unfolded (FIG. 6*a*) and bended position (FIG. 6*b*). The bathtub is this embodiment moulded in plastic, and the bendable joint is constructed by moulding it in flexible plastic (601) which makes it possible to fold up the surrounding side walls (602) as shown in FIG. 6*b*. This is for instance achieved by adding softeners to the part of the plastic which is used to mould the bendable joints or by using more flexible plastic material for the flexible joints than for the remaining part of the flexible bathtub. In another embodiment the bathtub is moulded in polystyrene, and the bendable joints are constructed by foaming the plastic, which constitutes the bendable joints, to a greater extent than the plastic in the remaining part of the bathtub. It is hereby achieved that the plastic, which constitutes the bendable joints, is more flexible than the rest of the bathtub. The bendable part could for instance be constructed by plastic materials such as Thermoplastic Elastomers (TPE) which is a family of polymers that can be repeatedly stretched without permanently deforming the shape of the part. Thermoplastic Elastomers (TPEs) may be processed by conventional thermoplastic techniques such as injection moulding, extrusion and blow moulding. The TPEs could for instance be chosen from the following groups: styrenic block copolymers, polyolefin blends (TPOs), elastomeric alloys, thermoplastic polyurethanes (TPUs), thermoplastic copolyesters and thermoplastic polyamides. The remaining part of the bathtub could for instance be made of a plastic material such as polypropylene copolymers (PP-CO), i.e. a type of polypropylene in which the basic structure of the polymer chain has been modified by the incorporation of a different monomer molecule.

Figure 7A:
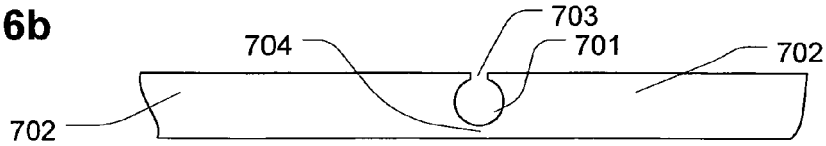
Figure 7B:
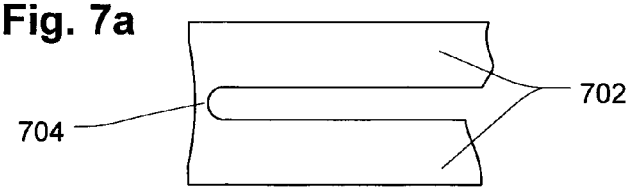

FIG. 7 illustrates a further embodiment of a bendable joint and shows a cross-sectional view of the bendable joint in an unfolded position (FIG. 7*a*) and in a collapsed position (FIG. 7*b*). The bendable joint is in this embodiment shaped as a profile where the side wall (702) is to be folded. In this embodiment the profile is shaped as a cylindrical cut-out (701) which via a rectangular cut-out (703) opens to the upper side of the side wall. This means that the side wall is provided with a bendable part (704) as this part of the side wall is thinner than the remaining part of the side wall. The side wall may therefore be folded up by bending this part as shown in FIG. 7*b*. The cylindrical cut-out will open at the rectangular cut-out when the sides are folded up. In contrast, the rectangular cut-out may be constructed such that it delimits the bending of the side wall in opposite direction. This is achieved by having two of the side walls in the rectangular cut-out converging when the side wall is folded in opposite direction. In an embodiment the bathtub is moulded in flexible plastic or polystyrene, wherein the flexibility of the plastic is adapted for bending when the side wall has a thickness corresponding to the thickness of the bendable part (704), while the remaining part of the side wall is unbendable as this part is thicker.

Figure 8A:
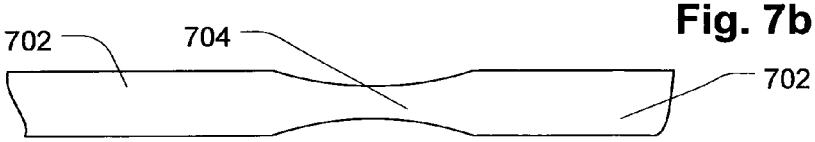
Figure 8B:
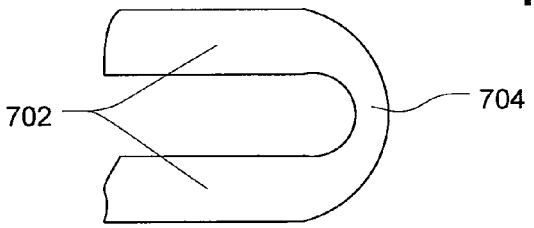

FIG. 8 illustrates another embodiment of a bendable joint and shows a cross-sectional view of the bendable joint in an unfolded position (FIG. 8*a*) and in a bended position (FIG. 8*b*). In principle, the embodiment illustrated in this figure corresponds to the embodiment described in FIG. 7, but in this embodiment the bendable part (704) of the side wall is constructed by removing a part of the upper side and underside of the side wall such that a thinner bendable part is created. The thinner bendable parts in a side wall may be constructed both during the moulding process and by mechanically removing material where the bendable joint is to be positioned.

Figure 9A:
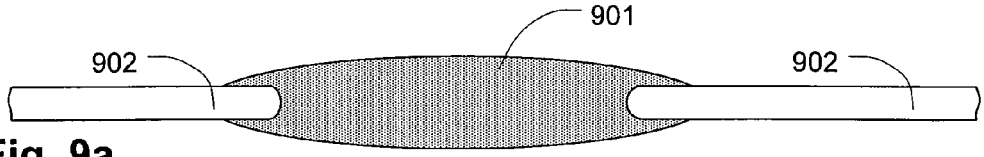
Figure 9B:
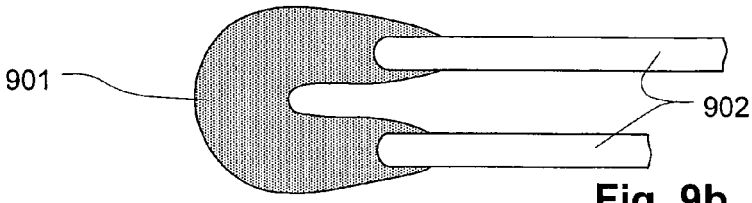

FIG. 9 illustrates another embodiment of a bendable joint and shows a cross-sectional view of the bendable joint in an unfolded position (FIG. 9*a*) and in a bended position (FIG. 9*b*). The bendable joint (901) is in this embodiment constructed by an oblong flexible material such as for instance silicone, rubber, flexible plastic or the like which is attached between two side walls (902). The oblong flexible material is bendable and the side walls are thus folded up as shown in FIG. 9*b*. This type of bendable joints may for instance be constructed by gluing the two side walls together by flexible silicone or rubber.

Figure 10:
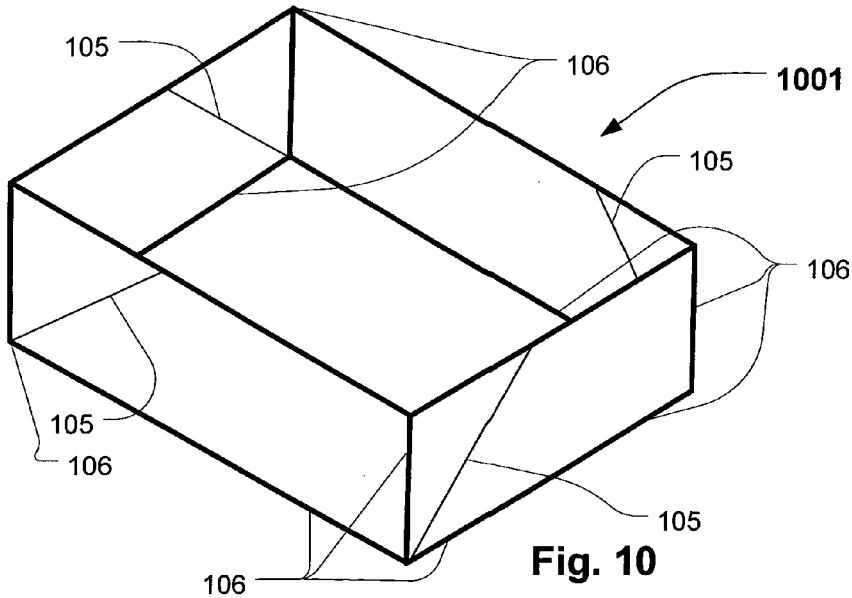
FIG. 10 illustrates another embodiment of the collapsible bathtub in an unfolded position.

FIG. 10 shows another embodiment of the collapsible bathtub (1001) in an unfolded position. In this embodiment the bathtub comprises flexible side bendable joints (105) around which a part of the side walls are foldable, and edge bendable joints (106) around which two different side walls and/or side walls and the bottom may be folded up. In contrast to the embodiment shown in FIGS. 1-3, this bathtub has edge bendable joints between bottom and side walls and does not comprise flexible bottom bendable joints. The edge bendable joints between the bottom and the side walls entail that the side walls are foldable down towards the bottom as illustrated in the following.

Figure 11:
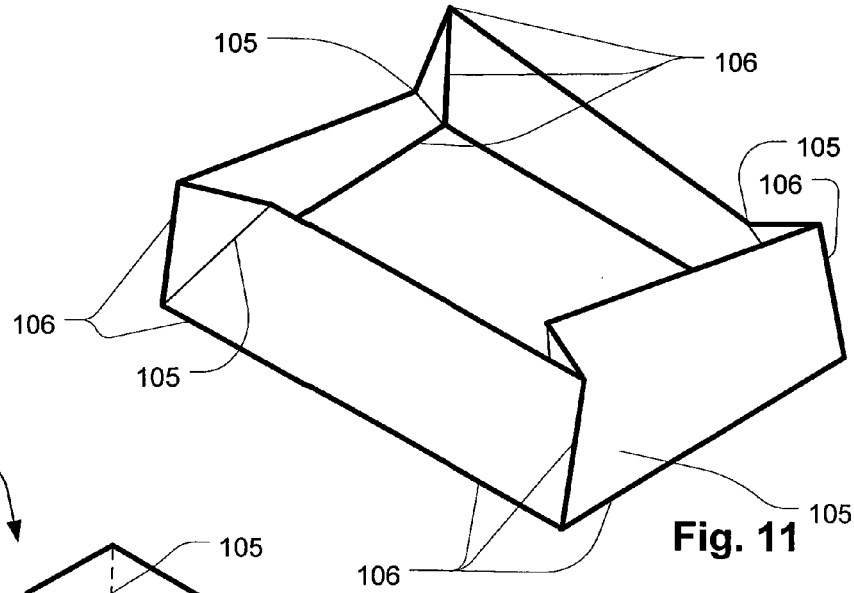
FIG. 11 illustrates another embodiment of the bathtub in a semi-collapsed position.

FIG. 11 illustrates the embodiment shown in FIG. 10 in a semi-collapsed position. This bathtub is folded by folding the side bendable joints (105) into the bathtub at the same time as the side walls are folded up and bended down towards the bottom.

Figure 12:
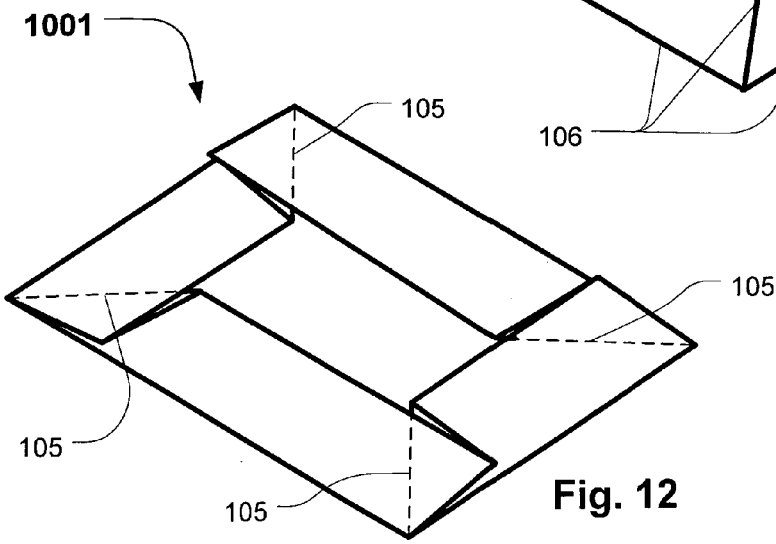
FIG. 12 illustrates another embodiment of the bathtub in a collapsed position.

FIG. 12 illustrates the embodiment shown in FIGS. 10 and 11 in a collapsed position. In this position the side walls are folded all the way down towards the bottom, and the side walls overlap one another at each corner. This way of folding up the bathtub is possible as long as the height of the side walls is smaller than half the width of the bathtub since two opposite side walls would otherwise converge when folded down.

Figure 13A:
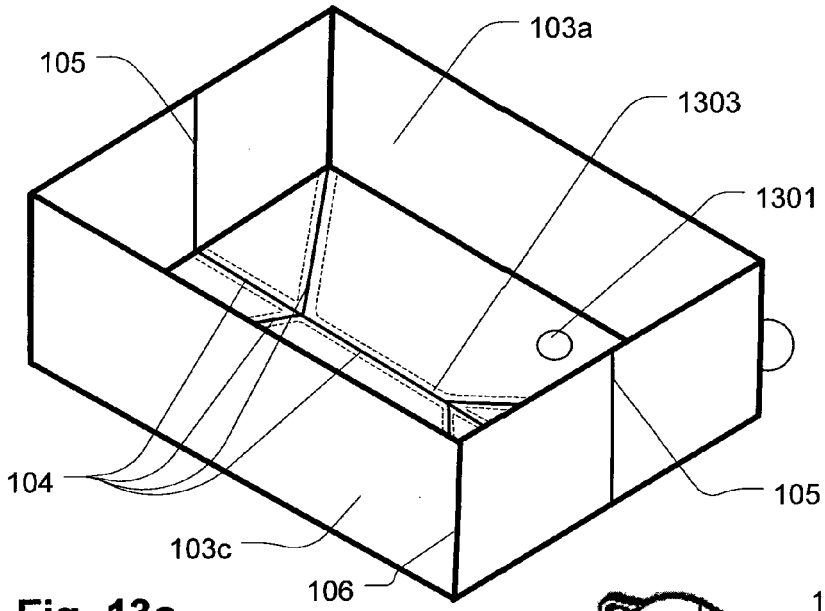
FIG. 13*a* illustrates yet an embodiment of the bathtub in an unfolded position.
Figure 13B:
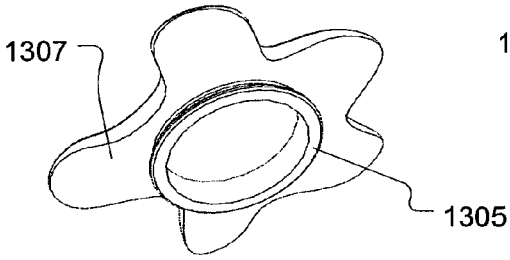
FIG. 13*b* illustrates an embodiment of an appurtenant plug for sealing an outlet in the bathtub.
Figure 13C:
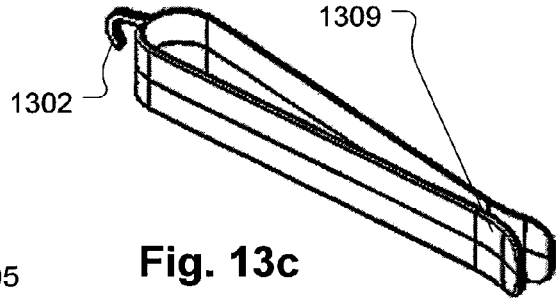
FIG. 13*c* illustrates a squeezer for squeezing the bathtub together in a collapsed position in accordance with one embodiment of the invention.

FIG. 13*a* illustrates an embodiment of the bathtub shown in FIGS. 1-3 where the bottom further comprises an outlet (1301) with appurtenant plug, for instance as illustrated in FIG. 13*b*. The plug comprises a plug portion (1305) adapted to be inserted in the outlet and an upper part (1307). The plug portion could for instance be threaded and comprises a sealing ring, and the plug could then be screwed into a thread in the outlet and would thus be very tightly sealed. Because of the outlet, the bathtub is more easily emptied after use. In addition this embodiment further comprises a noose (1302) positioned at one of the side walls of the bathtub and adapted for hanging on for instance a hook or a nail. The noose (1302) could in another embodiment, and as illustrated in FIG. 13*c*, be embodied at one end of a squeezer/peg (1309) which may be mounted around the side walls of the bathtub in the collapsed position. The squeezer would then squeeze the side walls of the bathtub together and help keeping the bathtub in a collapsed position. The bathtub could then be hung up by using the noose as described above and the squeezer could be positioned such that the bathtub is hung upside down enabling water to drip out the bathtub. The bathtub may thus be hung after being folded. In this embodiment the bendable joints further comprise soft mouldings illustrated by way of dotted lines (1303) which are attached to the bendable joints on the inner side of the bathtub in order to protect the bendable joints and to make the bathtub soft to sit in.

Figure 14:
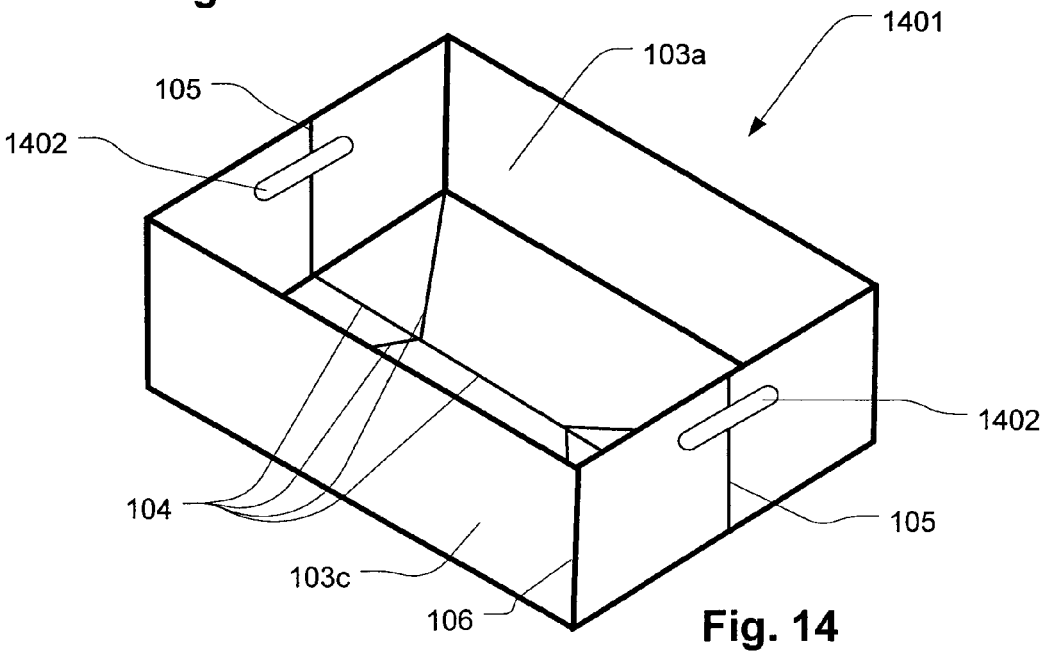
FIG. 14 illustrates a collapsible moving box. in accordance with one embodiment of the invention

FIG. 14 shows an alternative embodiment where the box, which constitutes the bathtub, is constructed as a collapsible moving box (1401). The box is constructed similar to the bathtub with bottom bendable joints (104), side bendable joints (105) and edge bendable joints (106) making the box foldable. The box further comprises handles (1402) constructed as cut-outs in the side walls of the box. In addition the box also comprises a lid (not shown) which is attached to one of the side walls by a bendable joint which makes opening and closing of the lid possible. Moreover, the lid comprises bendable joints positioned similar to the bendable joints in the bottom, whereby it is possible to also fold the lid such that it is folded in between two side walls of the box. It must be understood that the box does not necessarily need to be a moving box, but may also be used for other purposes and be constructed in different embodiments and dimensions.

Figure 15A:
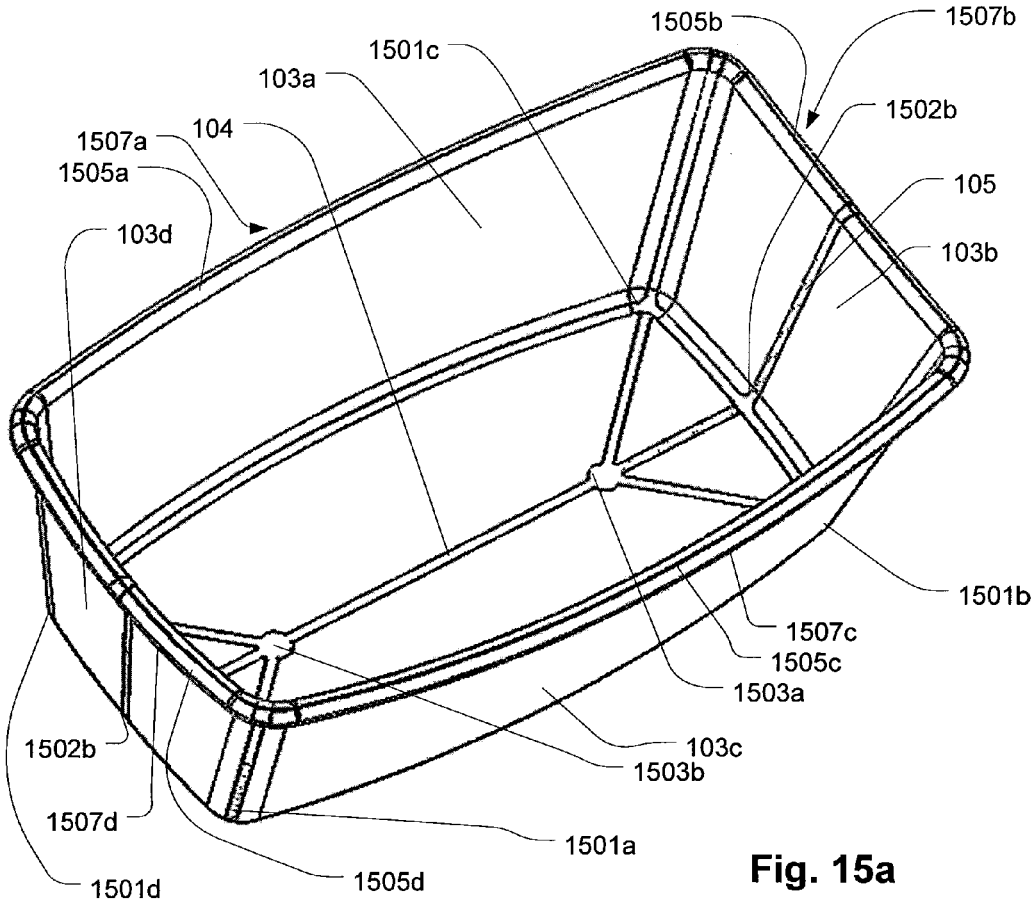
FIGS. 15*a* and 15*b* illustrate another embodiment of a collapsible bathtub.
Figure 15B:
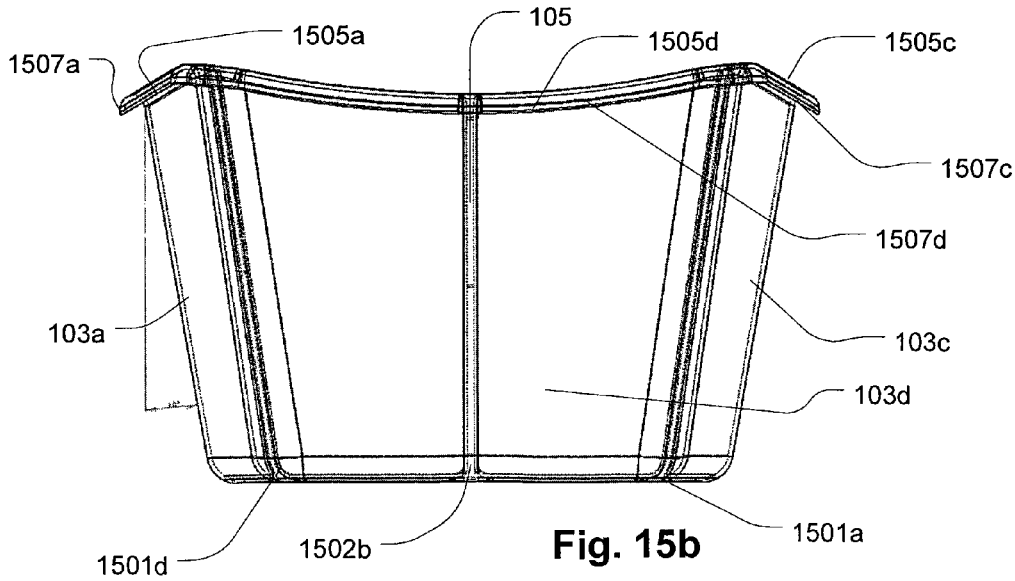

FIG. 15*a* illustrates a perspective view of another embodiment of the bathtub, and FIG. 15*b* illustrates the same bathtub seen from one end. The flexible joints have been embodied as described in FIG. 6, where the flexible joints are made of a plastic material being more flexible than the remaining part of the bathtub (bottom (102) and side walls (103*a*, 103*b*, 103*c*, 103*d*). The flexible joints are in this embodiment moulded and integrated into the bottom and side walls as described in FIG. 6. The bendable joints have been extended in positions around which more than two sides or bottom portions need to be bended. This is illustrated as corners positions (1501*a*, 1501*b*, 1501*c*, 1501*d*), side positions (1502*a*, 1502*b*) and bottom positions (1503*a*, 1503*b*). The bending around these positions is hereby performed much easier, and wear due to the bending is further reduced. It may further be seen that the bathtub comprises strengthen portions integrated as a part of the side walls. The strengthen portions are in the illustrated embodiment positioned at the upper part of the sides walls and comprise a curved portion (1505*a*, 1505*b*, 1505*c*, 1505*d*)) and an edge portion (1507*a*, 1507*b*, 1507*c*, 1507*d*). The curved portions are bending outwards of the bathtub's side walls such that the edge portions are approximately parallel to the side wall. The curved portions and edge portions serve to strengthen the side walls of the bathtub and thereby making bathtub more stable. The illustrated strength portions would prevent the side walls from bending in other places than at the bendable joints. One advantage of the illustrated embodiment is the fact that the bathtub could be moulded as one piece and strength portions are thus integrated as a part of the bathtub and does not need to be mounted subsequently.

It should be understood that the various embodiments of the invention as claimed in the present description and figures may be modified or changed and continue to fall within the scope of the following claims.

The invention claimed is:

1. A collapsible bathtub comprising a bottom first side walls and second side walls made of plastic, wherein the bathtub comprises at least one flexible bendable joint wherein at least a part of said bottom and/or first side walls are folded around said flexible bendable joint such that the part of the bottom is lifted between the second side walls simultaneously with the first side walls being folded in between the second sidewalls such that said bathtub has a collapsed position, and wherein at least a part of said bendable joint is made of a flexible plastic material being more flexible than the remaining part of said bathtub.

2. A collapsible bathtub according to claim 1, wherein at least a part of said flexible plastic material of said bendable joint is integrated with at least a part of said bottom and/or side walls.

3. A collapsible bathtub according to claim 1, wherein at least one of said bendable joint comprises at least one extended portion, where the extent of said bendable joint has been increased relative to at least another part of said bendable joint.

4. A collapsible bathtub according to claim 1, wherein at least one of said side walls comprises a least one strengthen portion.

5. A collapsible bathtub according to claim 4, wherein said at least one strengthen portion comprises a curved portion bending relative to said side wall and an edge portion being substantially parallel to said side wall.

6. A collapsible bathtub according to claim 1, wherein at least a part of said bendable joint is made of thermoplastic elastomer.

7. A collapsible bathtub according to claim 1, wherein at least a part of said bottom and/or side wall is made of polypropylene copolymer.

8. A collapsible bathtub according to claim 1, wherein the bathtub further comprises means for hanging adapted for hanging of said bathtub.

9. A collapsible bathtub according to claim 1, wherein said bathtub further comprises an outlet.

10. A collapsible bathtub according to claim 1, wherein at least one of said bendable joints is positioned such that said bottom and said side walls in said collapsed position are substantially parallel.

11. A collapsible bathtub according to claim 1, wherein at least one of said bendable joints is positioned such that at least a part of said bottom is positioned between at least two of said side walls in said collapsed position.

12. A collapsible bathtub according to claim 1 wherein the bendable joints are extended in positions around which more than two sides or bottom portions are bended.

13. A collapsible bathtub according to claim 1, wherein said at least one bendable joint is molded in flexible thermoplastic elastomer material being more flexible than the bottom, first side walls and second side walls and wherein at least a part of said bendable joint is molded and integrated into the bottom, first side walls and second side walls.

* * * * *